United States Patent [19]

Anderheggen et al.

[11] Patent Number: 4,688,590

[45] Date of Patent: Aug. 25, 1987

[54] PROCESS AND AN APPARATUS FOR THE DISTRIBUTION OF FLUIDS

[75] Inventors: Wolfgang Anderheggen; Winand Hahn, both of Dormagen; Roland Vogelsgesang, Leverkusen; Wolfram Wagner, Dormagen, all of Fed. Rep. of Germany

[73] Assignee: Bayer Aktiengesellschaft, Leverkusen, Fed. Rep. of Germany

[21] Appl. No.: 876,507

[22] Filed: Jun. 20, 1986

[30] Foreign Application Priority Data

Jul. 12, 1985 [DE] Fed. Rep. of Germany ..... 3524869

[51] Int. Cl.[4] ..... F16L 55/18; F16K 1/00

[52] U.S. Cl. ..... 137/15; 137/561 A; 137/567; 137/883

[58] Field of Search ..... 137/567, 561 A, 883, 137/15, 315

[56] References Cited

U.S. PATENT DOCUMENTS 3,496,261 2/1970 Parr ..... 137/567

*Primary Examiner*—A. Michael Chambers

*Attorney, Agent, or Firm*—Sprung Horn Kramer & Woods

[57] ABSTRACT

A fluid which flows through a distributing pipe and is distributed into several outlets branching from the distributing pipe may be displaced more rapidly by another fluid, for example when changing the color of spinning solutions, if the entire layer of fluid adjacent to the wall and located upstream of a chosen outlet is caused to flow out through this outlet.

6 Claims, 2 Drawing Figures

PROCESS AND AN APPARATUS FOR THE DISTRIBUTION OF FLUIDS

BACKGROUND OF THE INVENTION

The invention relates to a process for distributing fluids which flow through a distributing pipe to several outlets branching from the distributing pipe in which the displacement of a fluid by another fluid takes place more rapidly than hitherto.

The invention also relates to an apparatus for distributing fluids, comprising a distributing pipe and several outlets which are preferably similar and branch from the distributing pipe, in the form of pipes having a diameter smaller than that of the distribution pipe, for example a distributing pipe with which a spinning solution is distributed to several spinning points.

During the production of spun filaments by the spinning of a spinning solution or spinning melt, the solution or melt is conveyed through a distributing pipe via narrower pipes which branch from the distributing pipe (outlets) to the spinning points and is spun into filaments through the spinnerets. Problems arise when a spinning solution is exchanged, for example, for a colour change. As it is very expensive to switch off and clean the spinning machine and to start again with the new spinning solution or melt, the spinning operation is not interrupted by the former spinning solution or melt is displaced by the new spinning solution or melt. This often leads to change-over times which last for hours, in which unuseable material is produced because the new spinning solution or melt is mixed with the old one. The fact that faultless material is produced at the first spinning points branching from the distribution pipe, as viewed in the flow direction of the solution or melt, whereas reject material is still produced at the last spinning point is particularly undesirable. It is known that the filaments from a certian number of spinning points are combined to form a tow or cable and the tow thickness should as far as possible remain unchanged, even during the changeover time, so the faultless material must be discarded from the foremost spinning points until the last spinning point also produces faultless material.

This undesirable effect is due to the fact that, because of the friction between the fluid and the walls, the fluid transported in the centre of the distributing pipe flows more rapidly, so that the first fluid flowing next to the walls reaches the last outlet only when the second fluid is exclusively flowing out at the first outlets and the part of the second fluid flowing in the centre of the pipe has long before reached the last outlet.

SUMMARY OF THE INVENTION

An object of the present invention is to provide a process and an apparatus which enable the changeover time to be reduced and preferably to be restricted to the absolute minimum and to enable the pure second fluid to appear simultaneously at all outlets.

The object is achieved according to the invention in that the entire layer of fluid adjacent to the wall and located upstream of a chosen outlet is caused to flow out through this outlet.

In terms of apparatus, this object is achieved in particular in that a pipe insert having a smaller diameter than that of the distributing pipe is arranged in the vicinity of each outlet in the same direction in the distributing pipe.

The internal diameter of the pipe insert is preferably from 60 to 80% of the internal diameter of the distributing pipe. The external diameter of the pipe insert is preferably from 5 to 40% greater than the internal diameter of the pipe insert. The length of the pipe insert is, in particular, from 30 to 80% of the distance between two outlets. The centre of the pipe insert length may be located in the vicinity of the centre of the respective outlet. It is preferably shifted by 0 to 95% of the pipe insert length opposite to the flow direction of the fluid from the centre of the outlet.

The surfaces of the distributing pipe and the pipe inserts contacted by the fluid are preferably of similarly smooth texture to minimize pressure drops due to friction. The pipe inserts are fixed in the distributing pipe with spacers, the spacers preferably being designed in a manner opposing the favourably flow of fluid. It is also beneficial but not absolutely essential to arrange the pipe inserts concentrically in the distributing pipe.

DETAILED DESCRIPTION OF THE INVENTION

Figure 1:
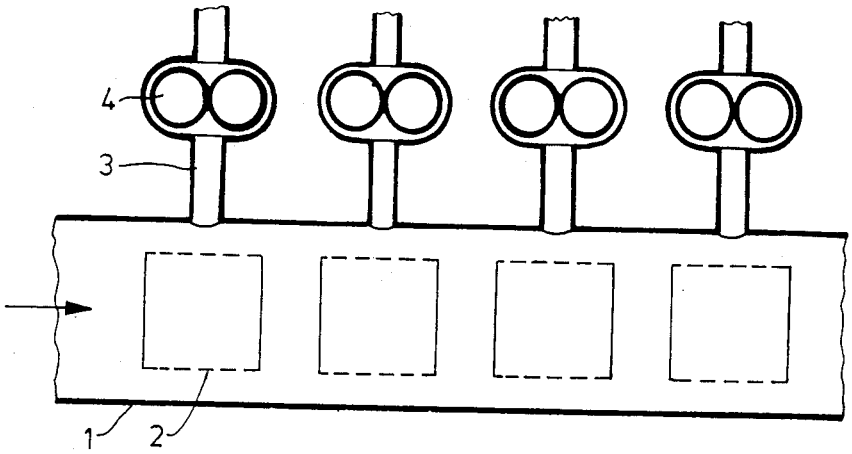
FIG. 1 show a longitudinal sketch.

FIG. 1 shows in a longitudinal section the distributing pipe 1 into which the fluid to be distributed flows in the direction of the arrow. Reference numeral 2 characterises the pipe inserts, 3 the outlets at whose ends there are arranged pumps 4 which convey the fluid further on, for example to the spinning points.

Figure 2:
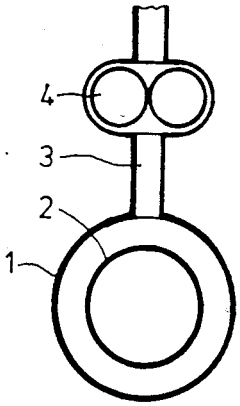
FIG. 2 shows a cross-sectional sketch of the apparatus according to the invention.

FIG. 2 shows a cross-section through the distributing pipe in the vicinity of an outlet.

The apparatus according to the invention is not restricted to a specific number of outlets, but the optimum number of outlets results from the pressure drop to be overcome and the associated expenditure. Although the pressure drop is increased by the pipe inserts inside the distributing pipe, this occurs to such an insignificant extent that it is not normally necessary to shorten the distributing pipe to a smaller number of outlets.

The apparatus according to the invention is suitable, in particular, for the distribution of spinning solutions or melts to several spinning points.

A reduction in the changeover times to at most 20% of the duration achieved with a conventional distributing pipe without fittings could be achieved.

Example

A 30% by weight spinning solution of an acrylonitrile copolymer composed of 93.6% by weight of acrylonitrile, 5.7% by weight of acrylic acid methylester and 0.7% by weight of sodium methallyl sulphonate having a K-value of 81 (Fikentscher, Cellulosechemie 13, (1932), page 58) in dimethylformamide was pumped via a distributing pipe having a diameter of 56 mm to 20 spinning ducts.

The outlets to the spinning ducts had a diameter of 18 mm and were arranged at intervals of 400 mm from one another.

Some 200 mm long insert pipes having an internal diameter of 46 mm and a wall thickness of 2 mm were arranged concentrically in the distributing pipe, the insert pipes having their centre offset initially by 90% then stepwise to the last outlet by 5% of the length of the pipe inserts against the flow direction of the fluid from the centre of the respective outlet. The quantity of spinning solution conveyed was 27 l/h. The spinning solution contained a red dye and was replaced by a spinning solution containing a blue dye at time 0.

The spinning solutions were dry spun from 1155 nozzles having a nozzle diameter of 0.2 mm at a drawing rate of 330 m/min. The residence time of the spun filaments in the spinning ducts was 15 seconds. The duct temperature was 180° C. and the air temperature 280° C. The quantity of air passed through was 50 $m^3/h$ for each duct and was blown at the head of the duct in a longitudinal direction to the filaments.

Filaments were produced with and without pipe inserts. The time from time 0 until all filaments were coloured perfectly blue, compared with a standard, was determined. This period is the so-called change-over time. The pressure drop was also determined.

(a) Distributing pipe without inserts
Change-over time: 111 minutes
Pressure drop: 0.7 bar (b) Distributing pipe with inserts
Change-over time: 15 minutes
Pressure drop: 2.3 bar

We claim:

1. A process for distributing spinning solutions or melts to several spinning points, comprising: feeding the solutions or melts into a distributing pipe; branching out from the distributing pipe to the spinning points with outlet pipes having a diameter smaller than that of the distributing pipe; disposing pipe inserts in the distributing pipe in the same direction and in the vicinity of each outlet pipe, wherein the internal diameter of each pipe insert is from 60 to 80% of the internal diameter of the distributing pipe and the external diameter of each pipe insert is smaller than the internal diameter of the distributing pipe and from 5 to 40% greater than the internal diameter of the pipe insert and wherein the length of each pipe insert is from 30 to 80% of the spacing between two outlet pipes.

2. A process according to claim 1, wherein the center of the pipe insert length is offset by 0 to 95% of the pipe insert length from the center of the associated outlet pipe and opposite to the fluid flow direction.

3. A process according to claim 1 or 2, wherein each pipe insert is positioned coaxially within the distributing pipe.

4. An apparatus for distributing fluids, comprising a distributing pipe, outlet pipes branching from the distributing pipe and having a diameter smaller than that of the distributing pipe, a pipe inserts for each outlet pipe, the pipe insert disposed in the same direction in the distributing pipe and in the vicinity of each outlet, wherein the internal diameter of each pipe insert is from 60 to 80% of the internal diameter of the distributing pipe, the external diameter of each pipe insert is smaller than the internal diameter of the distributing pipe and from 5 to 40% greater than the internal diameter of the pipe insert, and wherein the length of each pipe insert is from 30 to 80% of the spacing between two outlets.

5. An apparatus according to claim 4, wherein the center of each pipe insert length is offset by 0 to 95% of the pipe insert length from the center of the associated outlet pipe and opposite to the fluid flow direction.

6. An apparatus according to claim 4 or 5, where each pipe insert is positioned coaxially within the distributing pipe.

* * * * *